US010315122B2

(12) United States Patent
Bedford

(10) Patent No.: US 10,315,122 B2
(45) Date of Patent: Jun. 11, 2019

(54) DOLL CARRIER

(71) Applicant: ALLINFUN PTY LTD, Inverloch, Victoria (AU)

(72) Inventor: Andrew Martin Bedford, Inverloch (AU)

(73) Assignee: ALLINFUN PTY LTD., Interloch (AU)

( * ) Notice: Subject to any disclaimer, the term of this patent is extended or adjusted under 35 U.S.C. 154(b) by 0 days.

(21) Appl. No.: 15/695,115

(22) Filed: Sep. 5, 2017

(65) Prior Publication Data

US 2018/0065055 A1 Mar. 8, 2018

Related U.S. Application Data

(60) Provisional application No. 62/383,181, filed on Sep. 2, 2016.

(51) Int. Cl.

| | |
|---|---|
| ***A63H 3/00*** | (2006.01) |
| ***A63H 3/36*** | (2006.01) |
| ***A63H 3/50*** | (2006.01) |
| ***A63H 3/52*** | (2006.01) |

(52) U.S. Cl.
CPC ..... *A63H 3/36* (2013.01); *A63H 3/50* (2013.01); *A63H 3/52* (2013.01)

(58) Field of Classification Search
CPC .. A45C 1/02; A45C 11/32; A63H 3/00; A63H 3/36; A63H 3/50; A63H 3/52
See application file for complete search history.

(56) References Cited

U.S. PATENT DOCUMENTS

| | | | | |
|---|---|---|---|---|
| 2,667,906 | A * | 2/1954 | Stiller | B29C 39/003 150/150 |
| 4,563,159 | A | 1/1986 | Hills et al. | |
| 4,737,129 | A | 4/1988 | Gorley et al. | |
| 4,950,194 | A | 8/1990 | Gullace | |
| 5,623,980 | A * | 4/1997 | McMahon | A45C 1/02 150/150 |
| D402,465 | S * | 12/1998 | Barefoot | D3/303 |
| D414,216 | S * | 9/1999 | Crain, Jr. | D21/628 |
| D421,074 | S * | 2/2000 | Resich | D21/623 |
| 6,048,248 | A | 4/2000 | Ritchey | |
| D792,097 | S | 7/2017 | Bedford | |
| 2003/0075576 | A1* | 4/2003 | Condiff | A45F 5/02 224/269 |
| 2004/0144819 | A1* | 7/2004 | Huang | A45C 7/0086 224/583 |

(Continued)

OTHER PUBLICATIONS

Manhattan Toy Snuggle Pods Sweat Pea Baby Doll—walmart.com, available at https://www.walmart.com/ip/Manhattan-Toy-Snuggle-Pods-Sweet-Pea-Baby-Doll/51640667 (last accessed Sep. 5, 2017).

(Continued)

*Primary Examiner* — John Ricci
(74) *Attorney, Agent, or Firm* — Shane Cortesi

(57) ABSTRACT

A doll carrier is described. The doll carrier may include an elastic housing with a longitudinal slit and the width of the slit may be configured to expand widthwise upon pressing upon the top and bottom of the housing. The doll carrier may further include a clip allowing the carrier to be clipped to a backpack or another substrate.

18 Claims, 8 Drawing Sheets

(56) References Cited

U.S. PATENT DOCUMENTS

| | | | | |
|---|---|---|---|---|
| 2007/0235492 | A1* | 10/2007 | Sirichai ..... | A45C 11/00<br>224/675 |
| 2013/0171906 | A1 | 7/2013 | Smoot et al. | |

OTHER PUBLICATIONS

International Search Report and Written Opinion in corresponding International Application No. PCT/AU2017/050953 dated Oct. 6, 2017, 10 pp.

* cited by examiner

DOLL CARRIER

RELATED APPLICATIONS

This application claims priority under 35 USC 119 to U.S. Provisional Application No. 62/383,181, entitled "Doll Carrier" and filed Sep. 2, 2016, the contents of which are incorporated herein by reference in their entirety.

BACKGROUND

Technical Field

The present invention relates to toys, more particularly to doll carriers.

Background of the Invention

Baby dolls have been loved for generations.

Manhattan Toys sells a product available on Walmart.com under the name "Manhattan Toy Snuggle Pods Sweet Pea Baby Doll" that consists of a fabric doll located in a fabric housing.

However, there is a need for additional carriers of baby dolls, particularly miniature dolls that provide secure methods of transporting the dolls, and can be attached to other structures, such as children's backpacks.

BRIEF SUMMARY

The present disclosure provides a doll carrier and doll carrier system as described herein.

In some embodiments, the present disclosure provides a doll carrier system comprising:

a) an elastic housing comprising a hollow interior, a top, a bottom, a variable length extending from the top to the bottom, a left side, a right side, a variable width extending from the left side to the right side and generally perpendicular to the housing length, a slit comprising a slit top, a slit intermediate portion located below the slit top, a slit bottom located below the slit intermediate portion, a variable slit length extending from the slit top to the slit bottom and generally parallel to the housing length and a variable slit width generally parallel to the housing width, the slit leading to the hollow interior; and b) a doll located in the elastic housing interior, the doll having a head, two feet, a doll length extending from the head to the two feet and generally parallel to the housing length, and a doll width generally parallel to the housing width.

Optionally, the doll carrier has a relaxed state in which the housing has a first housing length and a first housing width and the slit has a first slit length and a first slit width. Optionally, the doll carrier has a compressed state in which the housing has a second housing length and a second housing width, and the slit has a second slit length and a second slit width. Optionally, the first housing length is greater than the second housing length, the first housing width is less than the second housing width, the first slit length is greater than the second slit length, and the first slit width is less than the second slit width. Optionally, the doll carrier is configured to move from the relaxed state to the compressed state by exerting force on the top and bottom of the housing.

Optionally, in the relaxed state, the housing width is tapered along the housing length. Optionally, the housing is curved and has no sharp edges. Optionally, the housing is generally in the shape of a pod. Optionally, the housing is comprised of an elastomeric material. Optionally, the doll width is less than the second housing width. Optionally, the doll comprises a torso, the torso having a torso width less than the first housing width. Optionally, in the relaxed state, the width of the slit top is greater than the width of the slit intermediate portion, the width of the intermediate portion is less than the width of the slit bottom, and the width of the slit top is greater than the width of the slit intermediate portion. Optionally, the slit top and the slit bottom are rounded. Optionally, the doll head comprises a doll head width generally parallel to the doll width and further wherein the doll head width is greater than the width of the top of the slit in the relaxed state. Optionally, the doll head is located outside of the housing interior and the doll feet are located inside the housing interior. Optionally, the slit bisects the housing. Optionally, the doll further comprises two arms and the housing interior is defined by a wall comprising an exterior surface and an interior surface, and further wherein the doll's arms contact the interior surface of the wall in the relaxed state. Optionally, the housing top is connected to a cable such as a rope. Optionally, the rope comprises a top end attached to a clip. Optionally, the rope has a diameter of approximately 1-10 mm, the rope has a length of approximately 10-50 mm, and the first housing length is approximately 1-5 inches. In an alternate embodiment, the clip may be directly attached to the housing top. Optionally, the doll further comprises two eyes, a nose, two ears and a mouth. Optionally, the housing comprises a front side and a rear side and a housing thickness extending from the front side to the rear side and generally perpendicular to the housing width and the housing length and further wherein the slit is located in the front side. Optionally, the doll length is approximately equal to the slit length and less than the housing length in the relaxed state.

BRIEF DESCRIPTION OF THE DRAWINGS

in FIG. 9A the slit moves away from the rear side of the housing.

in FIG. 9B the slit moves toward the rear side of the housing.

DETAILED DESCRIPTION

Figure 1:
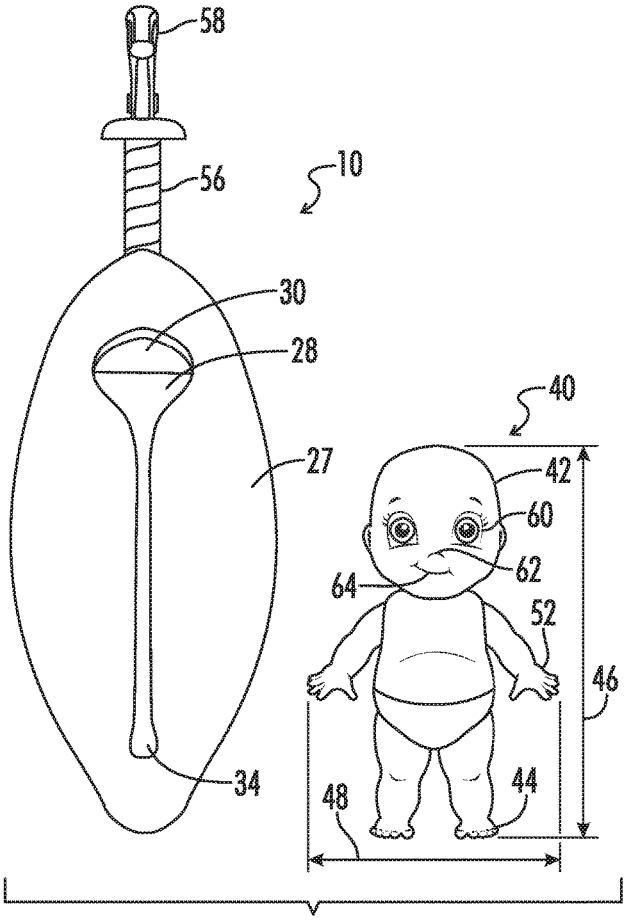
FIG. 1 is a front elevation view showing the doll carrier of an embodiment of the present invention with a doll next to the doll carrier.

With reference to FIGS. 1-14, the present invention provides a doll carrier system designated by the numeral 10. In the drawings, not all reference numbers are included in each drawing for the sake of clarity.

Referring further to FIGS. 1-14, in some embodiments, the doll carrier system 10 includes: an elastic housing 12 comprising a hollow interior 14, a top 16, a bottom 18, a variable length 20 extending from the top 16 to the bottom 18, a left side 22, a right side 24, a variable width 26 extending from the left side 22 to the right side 24 and generally perpendicular to the housing length 20, a slit 28 comprising a slit top 30, a slit intermediate portion 32 located below the slit top 30, a slit bottom 34 located below the slit intermediate portion 32, a variable slit length 36 extending from the slit top 30 to the slit bottom 34 and generally parallel to the housing length 20 and a variable slit width 38 generally parallel to the housing width 26, the slit 28 leading to the hollow interior 14.

Figure 2:
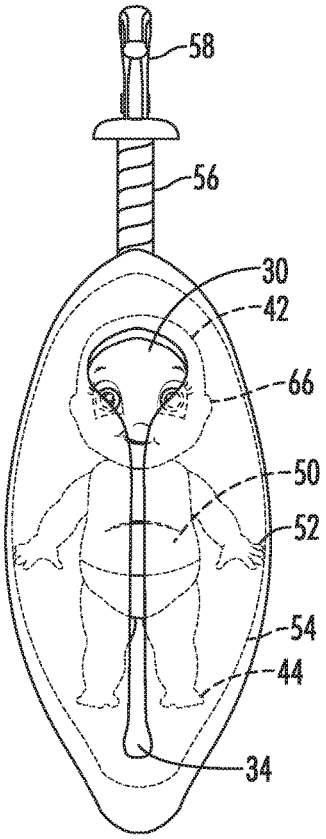
FIG. 2 is a front elevation view showing the doll carrier of FIG. 1 with the doll located in the doll carrier interior.
Figure 3:
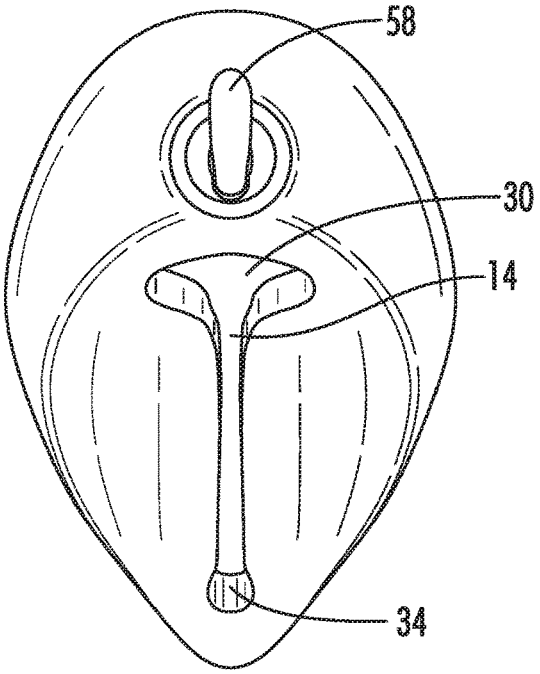
FIG. 3 is a top plan view showing the doll carrier of FIG. 1 without the doll.
Figure 10:
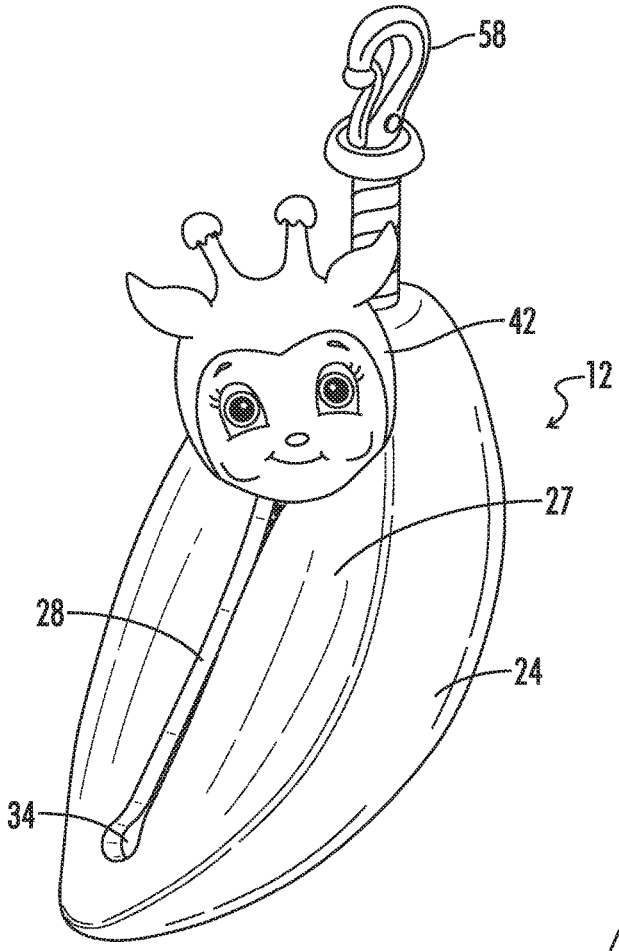
FIG. 10 is a front perspective view showing the doll carrier of FIG. 1 with the doll located in the doll carrier interior.
Figure 11:
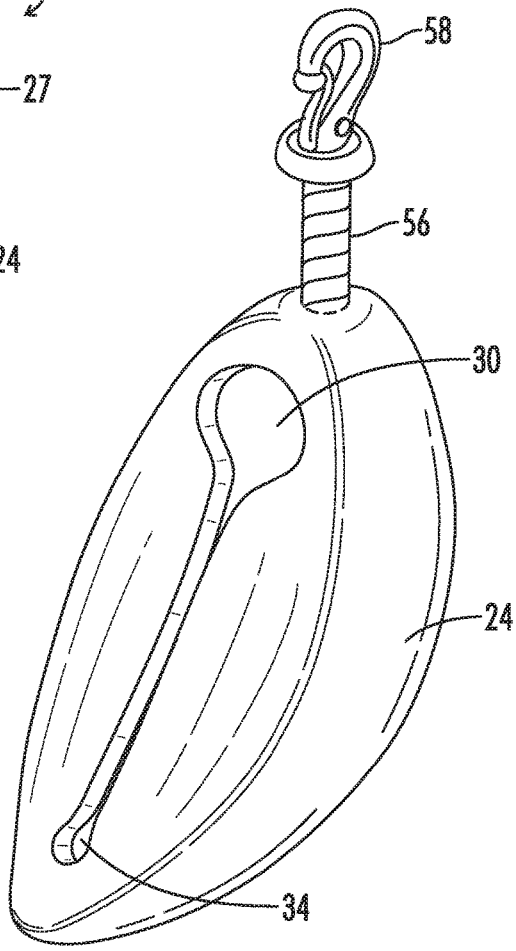
FIG. 11 is a front perspective view showing the doll carrier of FIG. 1 without the doll.

In some embodiments, as best seen in FIGS. 2 and 10 the doll carrier system 10 further includes a doll 40 located (i.e., at least partially located) in the hollow housing interior 14, the doll having a head 42, two feet 44, a doll length 46 extending from the head 42 to the two feet 44 and generally parallel to the housing length 20, and a doll width 48 generally parallel to the housing width 26. Preferably, the doll's head 42 but not the doll's torso 50 is located outside of the hollow interior 14, as best seen in FIG. 10.

Alternatively, as opposed to a doll 40, the hollow housing interior 14 may include a pet, such as a dog.

Figure 8:
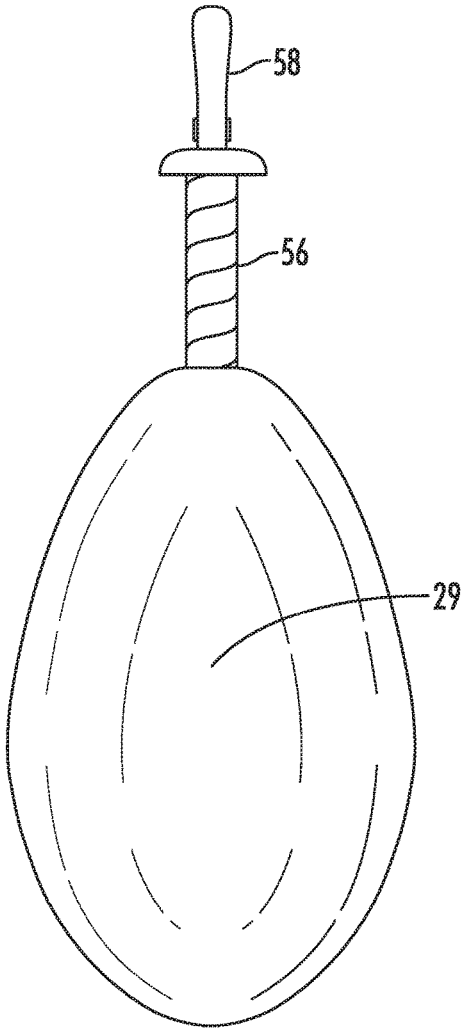
FIG. 8 is a rear elevation view showing the doll carrier of FIG. 1 without the doll.
Figure 9A:
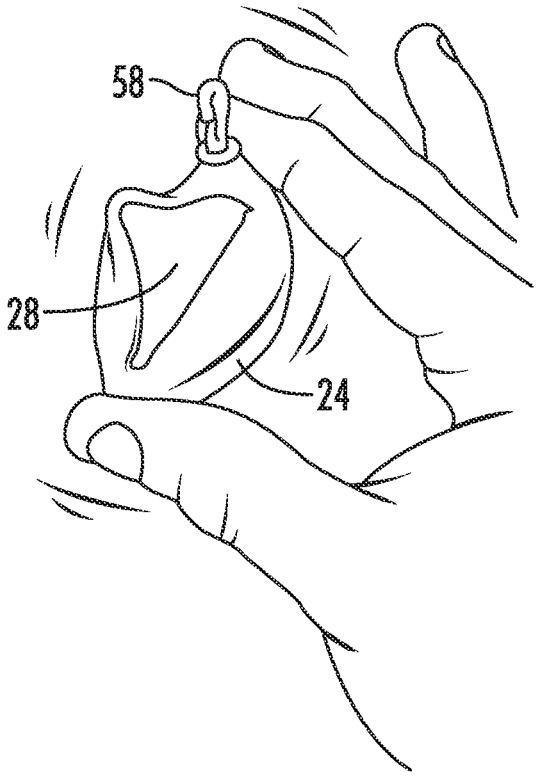
FIG. 9A is a front perspective view showing the doll carrier housing of FIG. 1 being moved to the compressed state by a person pressing on the top and the bottom of the housing.
Figure 9B:
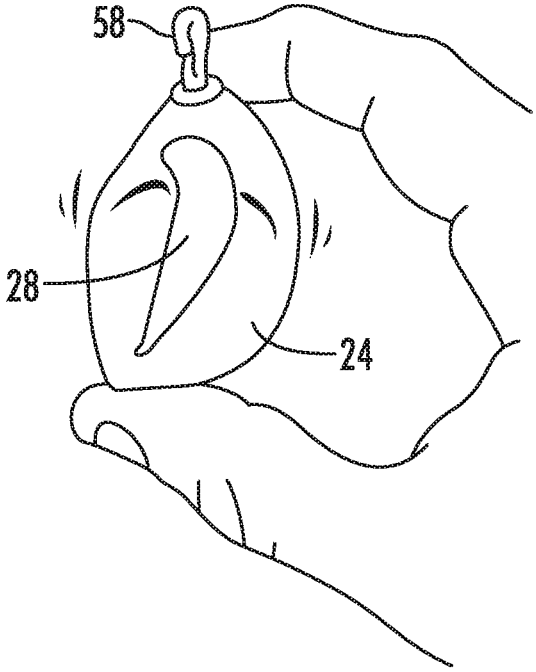
FIG. 9B is a front perspective view showing the doll carrier housing of FIG. 1 being moved to the compressed state by a person pressing on the top and the bottom of the housing.

Optionally, the housing 12 has a relaxed state in which the housing 12 has a first housing length and a first housing width and the slit 28 has a first slit length and a first slit width. The relaxed state is shown in FIGS. 1-8 and 10-13. Optionally, the housing has a compressed state in which the housing 12 has a second housing length and a second housing width, and the slit 28 has a second slit length and a second slit width, the first housing length greater than the second housing length, the first housing width less than the second housing width, the first slit length greater than the second slit length, the first slit width less than the second slit width. The compressed state is shown in FIGS. 9A and 9B and, as shown in FIGS. 9A and 9B, the housing 12 is configured to move from the relaxed state to the compressed state by exerting force (e.g., pressing) on the top 16 and bottom 18 of the housing 12. When the force is removed, the housing 12 returns to the relaxed state. (It will be understood that the first housing length refers to the length 20 of the housing 12 when the housing 12 is in the relaxed state and the second housing length refers to the length 20 of the housing 12 when the housing 12 is in the compressed state. The same terminology is applied in naming the first housing width, the second housing width, the first slit length, the second slit length, the first slit width and the second slit width). Optionally, when moving from the relaxed state to the compressed state, the slit intermediate portion 32 moves inwardly, as shown in FIG. 9B—i.e., towards the housing rear side 29—and the housing top 16 and housing bottom 18 begin to approach each other. In such a case, it may be preferable for the user to place one of his/her fingers in the slit 28 and pull a portion of the housing 12 adjacent to the slit 28 outwardly—i.e., away from the housing rear side 29 in order to place the doll 40 inside the housing interior 14. (FIG. 9A shows a portion of the housing 12 adjacent the slit 28 located outwardly). In certain embodiments, the housing top 16 and housing bottom 18 become adjacent or contact each other in the compressed state. FIGS. 9A and 9B show a slightly compressed housing 12; it may be possible to further compress the housing 12 with additional force.

The housing width 26, the housing length 20, the slit width 38 and the slit length 36 are referred to as variable because their dimensions vary from the relaxed state to the compressed state as described above, and shown by comparing FIGS. 1-8 and 10-11 with FIG. 9.

Optionally, in the relaxed state, the housing width 26 is tapered along the housing length 20. Optionally, the housing 12 is curved and has no sharp edges. For example, the housing 12 may be generally in the shape of a pod/banana. Optionally, the housing 12 is comprised of an elastomeric material (e.g., vinyl or thermoplastic rubber compound). The housing 12 preferably remains intact (e.g., does not tear or rip) while moving from the relaxed state to the collapsed state and then returning to the relaxed state. Optionally, the doll width 48 is less than the second housing width. Optionally, the doll 40 comprises a torso 50, the torso 50 having a torso width generally parallel to the doll width 48, the torso width less than the first housing width. Optionally, in the relaxed state, the width of the slit top 30 is greater than the width of the slit intermediate portion 32, the width of the intermediate portion 32 is less than the width of the slit bottom 34, and the width of the slit top 30 is greater than the width of the slit bottom 34. Optionally, the slit top 30 and the slit bottom 34 are rounded. (For example, the slit top 30 may be ovular in shape to allow the doll's head 42 to be exposed (as shown in FIG. 10), and the slit bottom 34 may also be rounded to prevent tearing.

Optionally, the doll head 42 comprises a doll head width generally parallel to the doll width 48 and the doll head width is greater than the width of the top of the slit 30 in the relaxed state. Optionally, the doll head 42 is located outside of the housing interior 14 and the doll feet 44 are located inside the housing interior 14, as shown in FIG. 10. Optionally, the slit 28 bisects the housing 12 in the relaxed state (i.e., the slit 28 may be located approximately in the center of the housing width 26).

Figure 12:
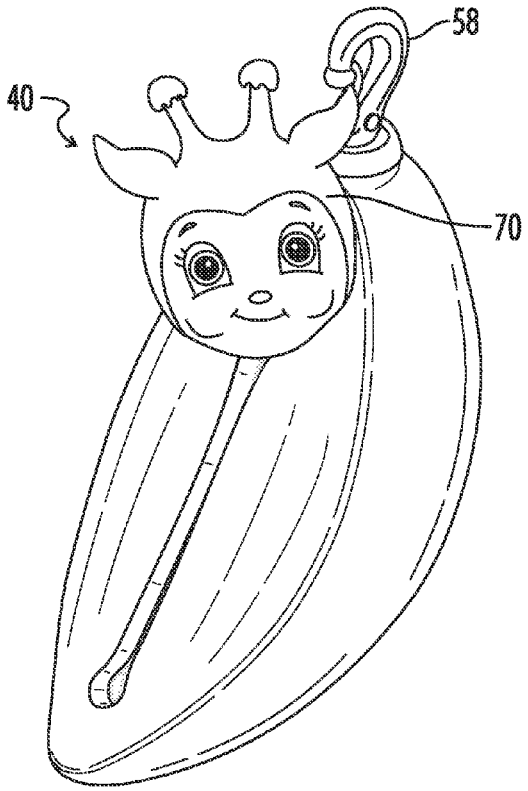
FIG. 12 is a front perspective view showing the doll carrier of an alternate embodiment of the present invention with the doll located in the doll carrier interior.
Figure 13:
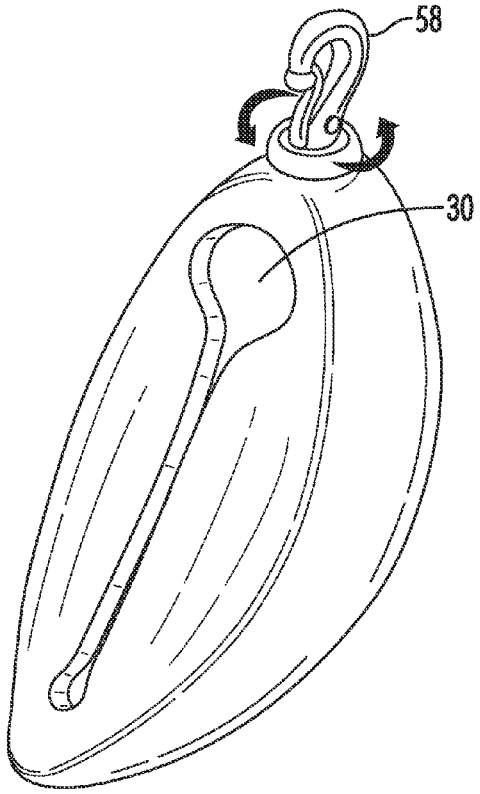
FIG. 13 is a front perspective view showing the doll carrier of FIG. 12 without the doll.

Optionally, the doll 40 further comprises two arms 52 and the housing interior 14 is defined by a wall 54 comprising an exterior surface and an interior surface, and further wherein the doll's arms 52 contact the interior surface of the wall 54 in the relaxed state, as best seen in FIG. 2. Optionally, the housing top 16 is connected to a rope/cord 56, as best seen in FIGS. 1, 2 3, and 5-11. Optionally, the rope 56 comprises a top end attached to a clip 58, and the clip 58 allows the housing 12 to be attached to a backpack for example. Optionally, the rope 56 has a diameter of approximately 1-10 mm, the rope 56 has a length of approximately 10-50 mm, and the first housing length is approximately 1-5 inches. In an alternate embodiment, the clip 58 may be attached directly to the housing top 16, as best seen in FIGS. 12-13, and the clip 58 may be configured to rotate/swivel relative to the housing top 16, as shown with the directional arrows in FIG. 13. In some embodiments, as shown in FIGS. 12-13, the clip 58 may be a two part construction with a top hook and a bottom cylinder/swivel point and the hook pierces the bottom cylinder, while the bottom cylinder in turn pierces the top 16 of the housing 14.

Figure 4:
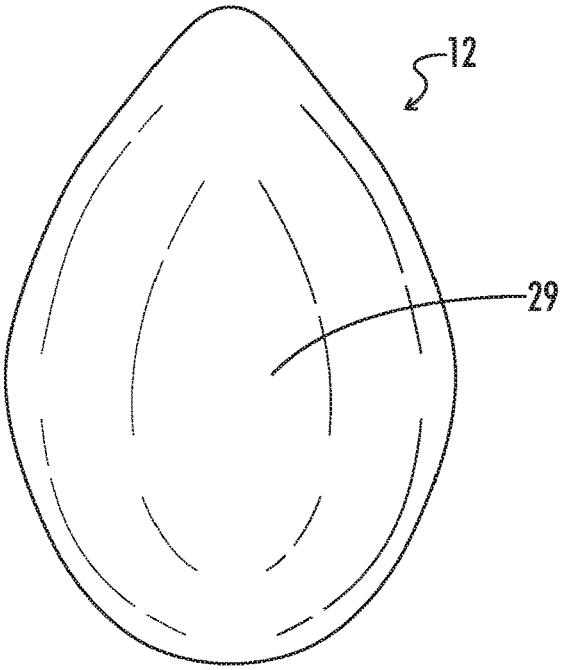
FIG. 4 is a bottom plan view showing the doll carrier of FIG. 1 without the doll and without the hook.
Figure 5:
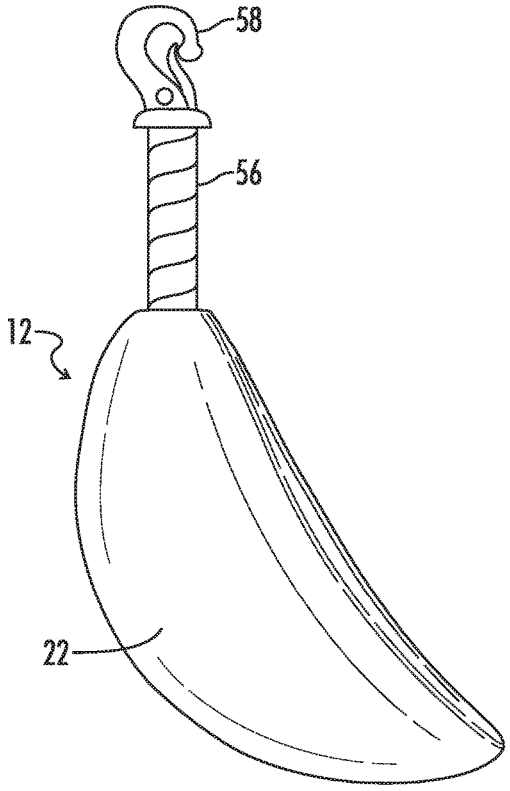
FIG. 5 is a left side elevation view showing the doll carrier of FIG. 1 without the doll.
Figure 6:
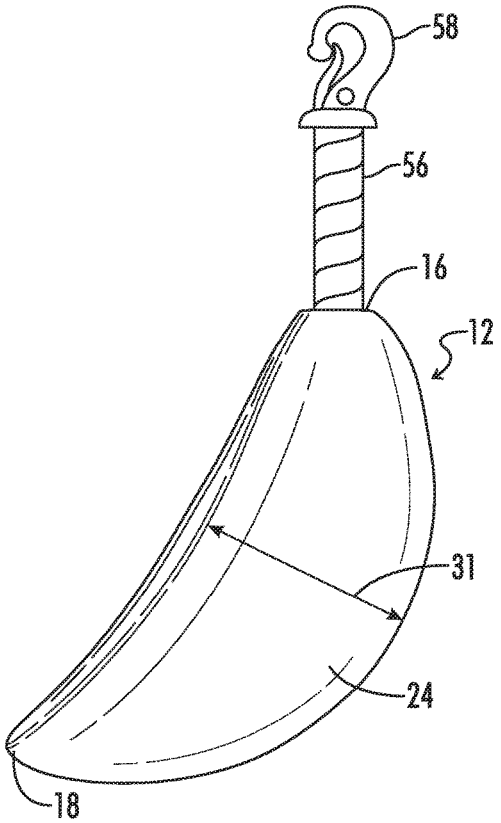
FIG. 6 is a right side elevation view showing the doll carrier of FIG. 1 without the doll.
Figure 7:
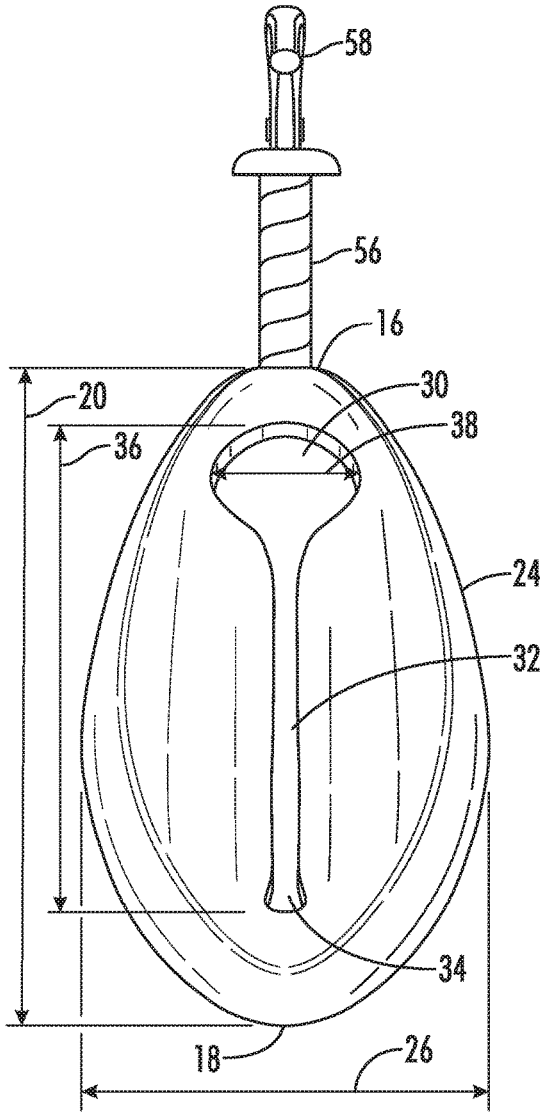
FIG. 7 is a front elevation view showing the doll carrier of FIG. 1 without the doll.

Optionally, the doll 40 further comprises two eyes 60, a nose 62, two ears 64 and a mouth 66. Optionally, the housing 12 comprises a front side 27 and a rear side 29 and a housing thickness 31 extending from the front side 27 to the rear side 29 and generally perpendicular to the housing width 26 and the housing length 20 and the slit 28 is located in the front side 27—i.e., the slit 28 does not extend through the entire housing thickness 31 as best seen in FIGS. 4 and 8 (no slit 28 in housing rear 29). Optionally, the doll length 46 is approximately equal to the slit length 36 and less than the housing length 20 in the relaxed state.

Figure 14:
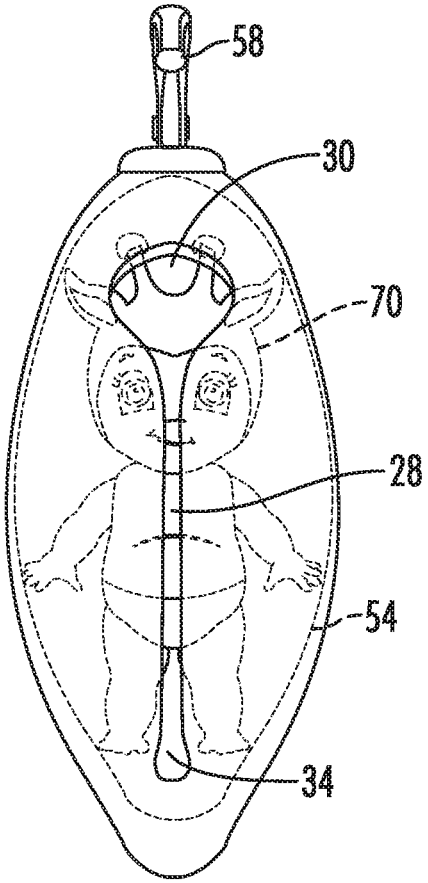
FIG. 14 is a front elevation view showing the doll carrier of FIG. 12 with the doll's head located in the doll carrier interior.

Optionally, the doll's head 42 is further fitted with detachable headgear 70 as shown in FIG. 12 and the width of the housing interior 14 is wide enough to accommodate the doll's head 42 fitted with detachable headgear 70, as shown in FIG. 14. Preferably the housing 12 does not include a zipper.

Part List

The below legend provides the numerals associated with the Figures.

| | |
|---|---|
| system | 10 |
| housing | 12 |
| housing interior | 14 |
| housing top | 16 |
| housing bottom | 18 |
| housing length | 20 |
| housing left side | 22 |
| housing right side | 24 |
| housing width | 26 |
| housing front side | 27 |
| housing rear side | 29 |
| housing thickness | 31 |
| slit | 28 |
| slit top | 30 |
| slit intermediate | 32 |
| slit bottom | 34 |
| slit length | 36 |
| slit width | 38 |
| doll | 40 |
| doll head | 42 |
| doll feet | 44 |
| doll length | 46 |
| doll width | 48 |
| torso | 50 |
| doll arms | 52 |
| interior wall | 54 |
| rope | 56 |
| clip | 58 |
| eyes | 60 |
| nose | 62 |
| mouth | 64 |
| ears | 66 |
| Head gear | 70 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A doll carrier system comprising:

a) an elastic housing comprising a hollow interior, a top, a bottom, a variable length extending from the top to the bottom, a left side, a right side, a variable width extending from the left side to the right side and generally perpendicular to the housing length, a slit comprising a slit top portion, a slit narrow intermediate portion located below the slit top portion, a slit bottom portion located below the slit narrow intermediate portion, a variable slit length extending from the slit top portion to the slit bottom portion and generally parallel to the housing length and a variable slit width generally parallel to the housing width, the slit leading to the hollow interior; and b) a doll located in the hollow interior, the doll having a head, two feet, a doll length extending from the head to the two feet and generally parallel to the housing length, and a doll width generally parallel to the housing width, wherein the housing has a relaxed state in which the housing has a first housing length and a first housing width and the slit has a first slit length and a first slit width, wherein the housing has a compressed state in which the housing has a second housing length and a second housing width, and the slit has a second slit length and a second slit width, the first housing length greater than the second housing length, the first housing width less than the second housing width, the first slit length greater than the second slit length, the first slit width less than the second slit width, wherein the housing is configured to move from the relaxed state to the compressed state by exerting force on the top and bottom of the housing, wherein, in the relaxed state, the slit top portion has a generally ovular shape and a slit top portion maximum width, wherein the slit narrow middle portion is generally straight and has a slit narrow middle portion maximum width, wherein the slit bottom portion has a slit bottom portion maximum width, wherein the slit top portion maximum width is greater than the slit bottom portion maximum width and the slit bottom portion maximum width is greater than the slit middle portion maximum width.

2. The doll carrier system of claim 1, wherein the housing is curved and has no sharp edges.

3. The doll carrier system of claim 1, wherein the housing is generally in the shape of a pod.

4. The doll carrier system of claim 1, wherein the housing is comprised of an elastomeric material.

5. The doll carrier system of claim 1, wherein the doll width is less than the second housing width.

6. The doll carrier system of claim 1 wherein the doll comprises a torso, the torso having a torso width less than the first housing width.

7. The doll carrier of claim 1, wherein the slit bottom portion is rounded.

8. The doll carrier of claim 1 wherein the doll head comprises a doll head width generally parallel to the doll width and further wherein the doll head width is greater than the width of the top portion of the slit in the relaxed state.

9. The doll carrier of claim 1 wherein the doll head is located outside of the housing interior and the doll feet are located inside the housing interior.

10. The doll carrier of claim 1, wherein the slit bisects the housing.

11. The doll carrier of claim 1, wherein the doll further comprises two arms and the housing interior is defined by a wall comprising an exterior surface and an interior surface, and further wherein the doll's arms contact the interior surface of the wall in the relaxed state.

12. The doll carrier of claim 1 wherein the doll further comprises two eyes, a nose, two ears and a mouth.

13. The doll carrier of claim 1 wherein the housing comprises a front side and a rear side and a housing thickness extending from the front side to the rear side and generally perpendicular to the housing width and the housing length and further wherein the slit is located in the front side.

14. The doll carrier of claim 1 wherein the doll length is approximately equal to the slit length and less than the housing length in the relaxed state.

15. The doll carrier of claim 1, wherein the slit narrow intermediate portion width is substantially constant along a length of the slit narrow intermediate portion.

16. The dollar carrier of claim 1 wherein the elastic housing top is connected to a clip.

17. The doll carrier of claim 16 wherein the clip is rotatably mounted to the top of the elastic housing, the clip configured to rotate relative to the length of the elastic housing.

18. The doll carrier of claim 16 wherein the clip is configured to rotate clockwise and counterclockwise relative to the length of the elastic housing.

* * * * *